US008468980B2

(12) United States Patent
Betzer Tsilevich

(10) Patent No.: US 8,468,980 B2
(45) Date of Patent: Jun. 25, 2013

(54) DIRECT CONTACT ROTATING STEAM GENERATOR USING LOW QUALITY WATER WITH ZERO LIQUID DISCHARGE

(75) Inventor: Maoz Betzer Tsilevich, Southwest Calgary (CA)

(73) Assignee: Ex-Tar Technologies, Inc., Calgary, Alberta (CA)

( * ) Notice: Subject to any disclaimer, the term of this patent is extended or adjusted under 35 U.S.C. 154(b) by 1134 days.

(21) Appl. No.: 12/406,823

(22) Filed: Mar. 18, 2009

(65) Prior Publication Data

US 2010/0037835 A1 Feb. 18, 2010

Related U.S. Application Data

(63) Continuation-in-part of application No. 12/037,703, filed on Feb. 26, 2008, now Pat. No. 7,814,867.

(51) Int. Cl.
*F27B 7/30* (2006.01)

(52) U.S. Cl.
USPC ..... 122/11; 122/367.4

(58) Field of Classification Search
USPC ..... 432/103, 219; 122/11, 12, 367.1, 122/367.4
See application file for complete search history.

(56) References Cited

U.S. PATENT DOCUMENTS

| | | | | |
|---|---|---|---|---|
| 1,313,281 | A | 8/1919 | Fasting | |
| 1,855,819 | A | 4/1932 | Blomquist et al. | |
| 1,857,785 | A * | 5/1932 | Holzapfel | 366/229 |
| 2,314,836 | A * | 3/1943 | Seil | 432/117 |
| 2,916,877 | A | 12/1959 | Walter | |
| 3,333,837 | A * | 8/1967 | Gustav | 432/118 |
| 3,395,905 | A * | 8/1968 | Isheim et al. | 34/137 |
| 4,060,587 | A * | 11/1977 | Lewis | 423/210 |
| 4,165,615 | A * | 8/1979 | Morcov | 60/685 |
| 4,207,290 | A * | 6/1980 | Lee | 422/109 |
| 4,398,604 | A | 8/1983 | Krajicek et al. | |
| 4,463,803 | A | 8/1984 | Wyatt | |
| 5,393,501 | A * | 2/1995 | Clawson et al. | 422/187 |
| 7,028,478 | B2 * | 4/2006 | Prentice, III | 60/645 |
| 7,814,867 | B2 * | 10/2010 | Betzer Tsilevich | 122/11 |
| 2006/0053791 | A1 * | 3/2006 | Prentice, III | 60/645 |
| 2010/0037835 | A1 * | 2/2010 | Betzer Tsilevich | 122/11 |
| 2011/0036308 | A1 * | 2/2011 | Betzer-Zilevitch | 122/5.52 |

FOREIGN PATENT DOCUMENTS

| | | |
|---|---|---|
| RU | 2 285 199 | 12/2004 |

* cited by examiner

*Primary Examiner* — Gregory A Wilson
(74) *Attorney, Agent, or Firm* — Egbert Law Offices, PLLC

(57) ABSTRACT

The present invention is a system for generating a mixture of steam and combustion gas in a direct contact rotating steam generator, using high solids content water and without waste liquid discharge. The invention includes a longitudinally pressurized rotatable drum, being mounted at a slope and having an energy injection section, a steam producing section, a water injection section and a discharge section. The discharge section is placed at an opposite end of the steam producing section and opposite the water injection section. There is an inlet in the combustion section of the rotatable drum, an outlet at an end of the rotatable drum, an injector for water at the highest point of the rotatable drum. There is also a discharge located at an end opposite said end of the rotatable drum. There are also pluralities of chains hanging within the rotatable drum.

18 Claims, 9 Drawing Sheets

DIRECT CONTACT ROTATING STEAM GENERATOR USING LOW QUALITY WATER WITH ZERO LIQUID DISCHARGE

CROSS-REFERENCE TO RELATED APPLICATIONS

The present application is a continuation-in-part of U.S. patent application Ser. No. 12/037,703, filed on 26 Feb. 2008, and entitled "REACTION CHAMBER FOR A DIRECT CONTACT ROTATING STEAM GENERATOR", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to an apparatus and method to produce steam, gas and solid waste without wastewater discharge. Low quality fuel and water are used in the direct contact heat exchange process. The procedure is carried out inside a rotating pressurized vessel.

2. Description of Related Art Including Information Disclosed Under 37 CFR 1.97 and 37 CFR 1.98

Generally, steam production facilities are divided into two main types: direct contact steam production facilities, and indirect steam facilities steam production facilities. In direct contact steam production facilities, water is mixed with hot gases to produce steam through direct heat exchange between the water and the gases. The end result is a mixture of steam and gas. In an indirect steam production facility, heat that is required to produce the steam from the water is supplied through a metal wall, typically a steel wall that prevents the mixture of the water and hot gases and allows a difference in pressure between the steam and combustion sides. Indirect contact steam generation is widely used for steam production. The devices vary from steam drum boilers to Once-Through Steam Generators (OTSG). The heat exchange can be by radiation, convection or both.

Direct-contact steam generators are much more limited in use than non-direct contact steam generators. One of the proven applications for the direct contact steam generation process is enhanced oil recovery (EOR), wherein steam and flue gas (mainly $CO_2$) mixtures are injected into a heavy oil reservoir to increase oil mobilization in heavy oil production.

The main characteristic of the direct contact steam generator is that the produced steam contains impurities, such as combustion products (mainly gases and possible solids) that were burned during steam production. Those gases are mainly carbon dioxide and nitrogen, when air is used for stoichiometric combustion processes. Additional gases can be present in smaller percentages, such as CO, $SO_x$, $NO_x$ and other gases. Due to the presence of combustion gases, the steam produced in direct contact will be used by open circuit systems or by systems that can handle the impurities in the steam.

The need for the present invention is driven by challenges facing the heavy oil production industry involved with enhanced oil recovery (EOR) and especially the negative environmental effect of that such oil development. For example, steam assisted gravity drainage (SAGD), cyclic steam stimulation (CSS) and open mining of tar sands generates large amounts of waste water and CO2 emissions. The disadvantages of the prior art direct contact steam generators prevented them from becoming preferred commercial solutions for EOR. As a result, indirect steam generators, mainly OTSG and steam boilers, are used commercially used. In the prior art, the systems of both direct and indirect steam generators have a continuous flow of water through them that maintains a solids concentration at acceptable levels in the steam vessel. Additionally, the flow of water controls solids build-up in the steam reactor for direct generators and in the drums or inside the tubes for indirect generators. The dissolved solids concentration increases in the steam reactor, as more water transitions from liquid to gas throughout the process. The water with the largest amount of concentrated solids is rejected from the steam generation process to crystallized treatment facilities or disposal wells. Thus, there is a need to eliminate the use of these additional treatment facilities for conversion of the waste into solid form.

The prior art of down-hole direct contact steam generators does not disclose continuous water flow through the system to remove the solids. However, the generated solids are released to a reservoir. These prior art systems are limited to the use of clean fuels and require clean water, since impurities and generated solids can block the reservoir.

There is also a need to utilize low quality carbon fuel such as coal, coke, and asphaltin as the energy source for steam production in the heavy oil production industry to replace the widespread use of natural gas. Natural gas is a clean and valuable resource that, from a public perspective, should not be used for steam production in heavy oil extraction. This clean resource should be preserved and used for residential purposes. The present invention can work with natural gas or other clean liquid/gas fuels, however, due to its ability to handle the solids both from the water and the fuel and remove $SO_2$, the use dirty fuel and water is preferred.

There is a major need to produce steam in a thermally efficient facility.

There is a need to use low quality water that contains solids including: silica clay from tailing ponds, dissolved solids and organic emulsions, (like tar and heavy oil-based materials), There is a need for low-quality water to be used directly, with minimal additional treatment prior to steam production.

There is a need to extract the continuously produced waste in a dry solid form that can be efficiently and economically disposed of in a landfill.

Above all, there is a need for an apparatus and process that will enable fulfilling the above-mentioned needs in a simple and reliable way.

Various patents have been issued that are relevant to the present invention. For example, U.S. Pat. No. 2,916,877, issued on Dec. 15, 1959 to Walter, teaches a pressure fluid generator, which utilizes direct-contact heat transfer. The pressure fluid generator is in the form of an elongated combustion chamber. A coolant in the heat exchange relationship is injected into the combustion chamber to form with the combustion products therein, as a gas and superheated vapor-working mixture at a relatively high temperature and pressure. Some embodiments include in-line soot filters and circulated water, and the fuel is hydrocarbon gas.

U.S. Pat. No. 4,398,604, issued on Aug. 16, 1983 to Krajicek et al. describes a system for aboveground stationary direct contact horizontal steam generation. The method and apparatus produces a high-pressure thermal vaporized stream of water vapor and combustion gases for recovering heavy viscous petroleum from a subterranean formation. High-pressure combustion gases are directed into a partially water-filled vapor generator vessel to produce a high-pressure stream of water vapor and combustion gases. The produced solids are continually removed with reject water.

There are also patents relating to applications in heavy oil production. U.S. Pat. No. 4,463,803, issued to Wyatt on Aug. 7, 1984 describes a system for down-hole stationary direct contact steam generation for enhanced heavy oil production. The method and apparatus generate high-pressure steam within a well bore. The steam vapor generator is constructed for receiving and mixing high-pressure water, fuel and oxidants in a down-hole configuration. The produced solids are discharged to the oil reservoir.

Various patents have disclosed rotational elements of steam generators. U.S. Pat. No. 1,855,819, issued on Apr. 26, 1932 to Blomquist et al. describes a rotary boiler, where the pressure chamber is rotating inside the combustion area while producing the steam in an adjacent indirect heat exchanger. To increase the efficiency of the invention, Blomquist used scraper chains within the steam generating tubes, to prevent the sludge from adhering to the tubes interior walls. British patent No. 0 328 339, issued on May 1, 1930 to Kalabin teaches a direct contact steam generator with a rotating pressure vessel. The gasses flow to a rotating chamber, where they are mixed with air and combusted completely. Water covers the walls of the rotating chamber. This is achieved by the centrifugal force of the rotating chamber, exposing the water to gas combustion.

Various patents have disclosed rotating drums with chains as heat exchange elements. These are designed to capture heat from the combustion gas and transfer it to the liquid or slurry medium. U.S. Pat. No. 1,313,281, issued on Aug. 19, 1919 to Fasting describes a rotary kiln for slurry material. The chains lift the slurry onto the path of the hot combustion products, to increase the heat transfer and slurry evaporation. U.S. Pat. No.4,207,290, issued on Jun. 10, 1980 to Lee, discloses a flue gas scrubber. The elongated tubular drum scrubber, fitted with chains as means of heat transfer, is used for increasing the direct contact between lime slurry and sulfur rich flue gas. The rotating scrubber has two main areas: a scrubbing area with liquid slurry and a drying area. In the drying area, the heat from the flue gas evaporates the moisture to generate dry pellets.

The use of a rotating drum drier with chains is common as a method of heat transfer in several industries. For example, the pulp and paper industry. In the aforementioned application, the products are the solids. The liquids and moisture are driven out of the product and released to the environment, close to atmospheric pressure. In many cases, the heat from the produced solids is used to pre-heat the combustion air. Usually, excessive water within the solids results in severe energy wastes and high fuel costs, due to the expensive process of drying and loosing the liquids.

The use of rotating kiln with chains as a means of heat exchange has been an industrial standard since the beginning of the $19^{th}$ century. (See The Rotary Cement Kiln by Peray and Waddell, Published 1972, paragraph 1.3 and 3.5.). The use of chains for internal heat exchangers became popular with kiln operators because of their simplicity and ease of operation. In wet processes, a feed enters the cement kiln in the form of slurry with approximately 30% moisture content. The slurry temperature is approximately 38° C. as it enters the chains. The temperature rises to 200-260° C. when it leaves the chains. The slurry helps reduce the dust. In a dry kiln, the feed is in powder form. The temperature in the chain section increases the feed temperature to 565-705° C. In this section, the mixture is partially calcined.

It is an objective of the present invention to provide an apparatus and method for the production of high pressure, dry, super-headed steam and a combustion gas mixture using direct contact heat transfer between available water and combustion gases in a rotating reactor.

It is another object of the present invention to provide an apparatus and method where the waste solids generated by combustion and steam generation are carried by gravity to regenerated surfaces at the bottom of the apparatus. These regenerated surfaces are chains that hang in the rotating vessel of the apparatus. The chains act as heat transfer media and they remove deposits and build-ups of waste solids.

It is another object of the present invention to provide an apparatus and method where the waste solids are separated and removed in the form of dry particles or high concentrated slurry from the rotating steam generator by carry gas mixture, without decreasing the steam-gas mixture pressure and temperature.

It is another object of the present invention to provide an apparatus and method that produces steam from low-quality tailing pond and reject-water containing high levels of dissolved inorganic solids or organic solids. All liquid water is converted to steam and no liquid is discharged from the apparatus.

It is another object of the present invention to provide an apparatus and method that produces steam from low-quality fuel containing inorganic impurities. For example, coal, coke, asphaltin or any other available carbon based fuel, wherein the combustion byproducts of this fuel are slag and ash in solid form.

It is another objective of the present invention to provide an apparatus and method that minimizes the amount of energy used to produce the mixture of steam and gas that is injected into underground formation to recover heavy oil.

It is a further objective of the present invention to provide an apparatus and method where the low quality water is converted to steam, without any wastewater flow.

It is another objective of the present invention to provide a process that produces pressurized high-temperature steam and gas in a rotating drum. Solids are removed in dry form from the rotating drum. The hot gas flow and the remaining solids are injected into a vessel, where the solids are scrubbed by liquid water. A saturated, wet, steam and combustion gas is produced. Water with solids continually recycled back from the vertical vessel to the rotating steam generator. The saturated wet steam-gas mixture is used for enhanced oil recovery processes.

BRIEF SUMMARY OF THE INVENTION

The main advantage of the present invention over the direct contact steam generation of the prior art is its ability to use low quality water and fuel. Also, its ability to avoid liquid discharge waste. And finally its ability to remove a solid waste by product, when all water has been converted to steam and fuel has been converted to gas. In the present invention, solids concentration increases inside the steam generator. Maximum concentration is reached when the liquid becomes gas and solid. The extraction of the produced solid waste as part of the steam generation process is advantageous, as it eliminates the need for additional facilities to treat the water prior to use in the steam generator. In this way, there is no need to separately convert a wastewater flow into solid form (For example, using evaporators and crystallizers). The disposal of solid waste in landfills is more economical and environmentally friendly.

Furthermore, the proposed apparatus and method allows direct use of coal or petcoke for heavy oil recovery, eliminating the need to burn natural gas to produce steam for heavy oil recovery. The present invention minimizes the use of a clean and valuable natural gas resource by replacing it with coal or other low quality fuels. Additionally, harmful $CO_2$ gas emissions can be recovered for sequestration or they can be injected, along with the produced steam, into an underground reservoir.

The present invention is also a reaction chamber apparatus for producing a steam and combustion gas mixture without generating liquid waste. The apparatus includes a rotating vessel in a direct contact steam generator. The rotating vessel has a combustion gas injection section and a steam producing section and is partially filled with metal chains. The combustion section and the steam producing section can be partially separated by a partition located in the rotating chamber. The rotating pressurized drum has at least one opening with a fixed collector at the bottom to allow for the discharge of solids.

The combustion gases can be generated in combustion chamber inside the pressurized rotating drum or in a pressurized fixed combustion pressurized apparatus, like pressurized boiler, separate from the rotatable steam-generating vessel. The combustion and steam-generating vessels are both pressurized and are in direct fluid communication with one another. The steam-generating drum is partially filled with chains and has a solids discharge outlet at the bottom of the drum. The chains and the solids discharge outlet are design to prevent interaction damage between the fixed discharge pipe and the rotating vessel.

The present invention is also a method for producing a steam and $CO_2$ mixture, comprising of several steps. First, of combusting carbon fuel with an oxidation gas in a burner under high pressure and temperature. Secondly, injecting the pressurized hot combustion gas to a rotating drum; and finally, injecting low quality water containing organic or inorganic materials to generate steam in the rotating drum. The waste solids generated by the combustion and steam generation are driven by gravity to regenerated surfaces at the bottom of the rotating drum. The heat transfer rate is increased by the use of chains attached to the rotating drum wall. The chains regenerate their own surface and the vessel internal walls surfaces due to their movement to prevent solids build-ups in the rotating chamber. The fuel is selected from a group consisting of coal, heavy bitumen, vacuum residuals, asphaltin, and coke. The oxidation gas is selected from a group consisting of oxygen, oxygen-enriched air, and air. The chains improve mixing and heat transfer. The first step of combusting carbon fuel with an oxidation gas can tack place inside the rotating drum.

The step of combustion includes converting the fuel to a gas and byproducts into solid or liquid form, (such as slag, fly ash and char). The step of steam generation includes converting water from a liquid phase to a gas phase, the gas phase containing steam and at least $CO_2$. Solids are also separated from the gas phase.

The method of the present invention includes the steps of separating the gas and the steam from fine solid particles in a separator or in the rotating steam generator, mixing the gas and steam with water of high temperature and pressure so as to produce a saturated wet steam and gas mixture, scrubbing any remaining solids from the gas, separating the liquid phase from the gas phase, and recycling the water with the scrubbed solids back to the rotating chamber. In the event that the gas contains sulfur, (if there is a need to reduce the amount of sulfur), the process can include adding lime or other chemicals during the step of scrubbing and then reacting the lime or dolomite with the sulfur.

The saturated steam and gas mixture is used for EOR. It can be heated with the hot gas phase, leaving the combustion chamber to generate super-heated steam and gas, preventing condensation on the pipes of the apparatus. As another option, the mixture can be condensed and re-heated to generate a flow of pure steam and non-condensable combustion gases.

Additives can be injected into the gas phase to protect the pipe from corrosion. The pressure of the clean, wet, steam is reduced to an injection pressure. The pressure of the dry steam and gas mixture is between 800 and 10,000 kpa. The temperature of the dry steam and gas mixture is between 170° C. and 650° C. The super-heated dry steam and gas mixture can be injected into an underground reservoir through a vertical or horizontal injection well, for example, in EOR.

DETAILED DESCRIPTION OF THE INVENTION

Figure 1:
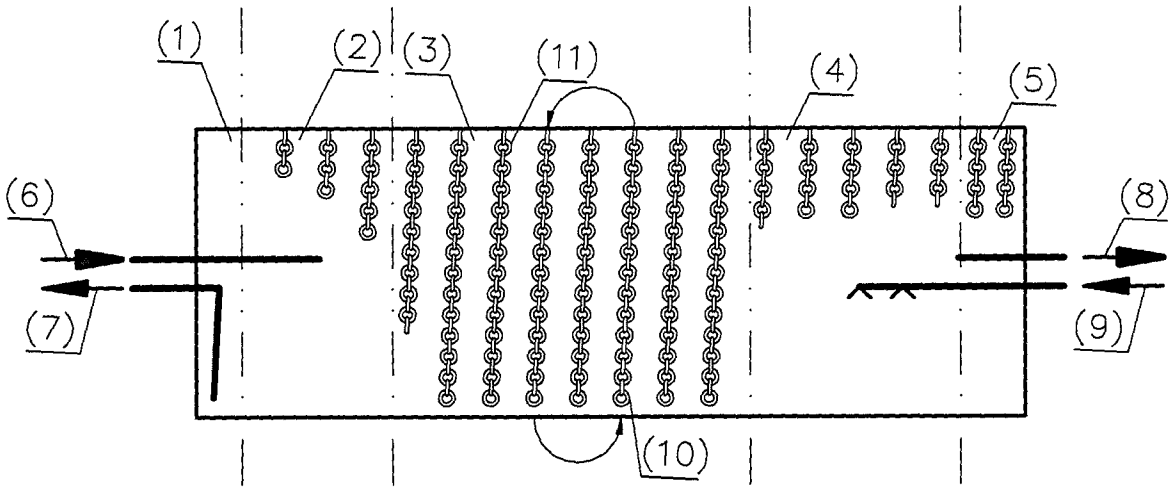
FIG. 1 is a schematic view of a reaction chamber apparatus in a rotating direct-contact steam generator of the present invention.

FIG. 1 shows the reaction chamber apparatus of a high-pressure direct contact steam generator of the present invention. A counter-flow horizontally-sloped pressure drum 11 is partially filled with chains 10 that are free to move inside the drum and internally connected to the drum wall. The drum 11 is a pressure vessel and is continually rotating, or rotating at intervals. At a low point of the sloped vessel 11, hot combustion gases generated by a separate unit like the pressurized boiler (not shown) are injected 6. The fuel can be coal slurry, coke, or hydrocarbons such as untreated heavy low quality crude oil, VR (vacuum residuals), asphaltin, coke, or any other available carbon or hydrocarbon fuel. The oxidizer is a gas (pure oxygen, air, or enriched air). The pressure inside the rotating drum can vary between 2 bar and 100 bar according to the oil underground formation.

The vessel is partially filled with chains 10 that are internally connected to the vessel wall and are free to move. The chains 10 provide an exposed regenerated surface area that works as a heat exchanger and continually clean the insides of the rotating vessel. The flowing gas temperature 6 for high slag fuel is preferably less than 800° C., at which the slag and ash generated in the combustion are solid. The ash and solid deposits left from the reaction (mainly silica, heavy metals etc. that result from the specific type of fuel in use) are settled on the exposed surfaces, mainly the surface area of the chains 10. Due to the rotational movement, the chains regenerate their surface area and remove solids deposits from the walls of vessel 10.

Low quality water, like mature tailing pond water, rich with solids and other contaminants (like oil based organics) are injected into the opposite higher side of the vessel at section 4 where they are mixed with the hot combustion gases and converted into steam. This heat exchange and phase exchange continues at section 3 where the heavy liquids and solids move downwards directly opposite to the combustion gases. The combustion gases injected at section 2, which is located at the lower side of the sloped vessel, moves upwards while converting liquid water to gas. The heat exchange between the gases to the liquids is increased by the use of chains that maintain close contact, both with the hot combustion gas and with the liquids at the bottom of the rotating vessel.

The amount of injected water is controlled to produce steam in which the dissolved solids become dry or high solids concentration slurry and most of the liquids become gases. Additional chemical materials can be added to the reaction, preferably with any injected water. For example, limestone slurry can be added to the low quality water. Steam production section 3 contains chains. When the liquids (primarily water) evaporate, the solids settle on the internal exposed surfaces, mainly on the surface area of the chains 10. The rotational movement regenerates the surface area of the chains by removing the solid deposits there to and from the vessels walls.

The heat transfer in section 3 is sufficient to provide a homogenous mixture of gas and ground-up solids or high viscosity slurry. Most of the remaining liquid transitions to gas and the remaining solids are moved to a discharge point 7 at the lower internal section of the rotating vessel near the rotating pressurized drum 11 wall. The solids or slurry are released from the vessel 11 at high temperature and pressure. They undergo further processing, such as separation and disposal.

Figure 2:
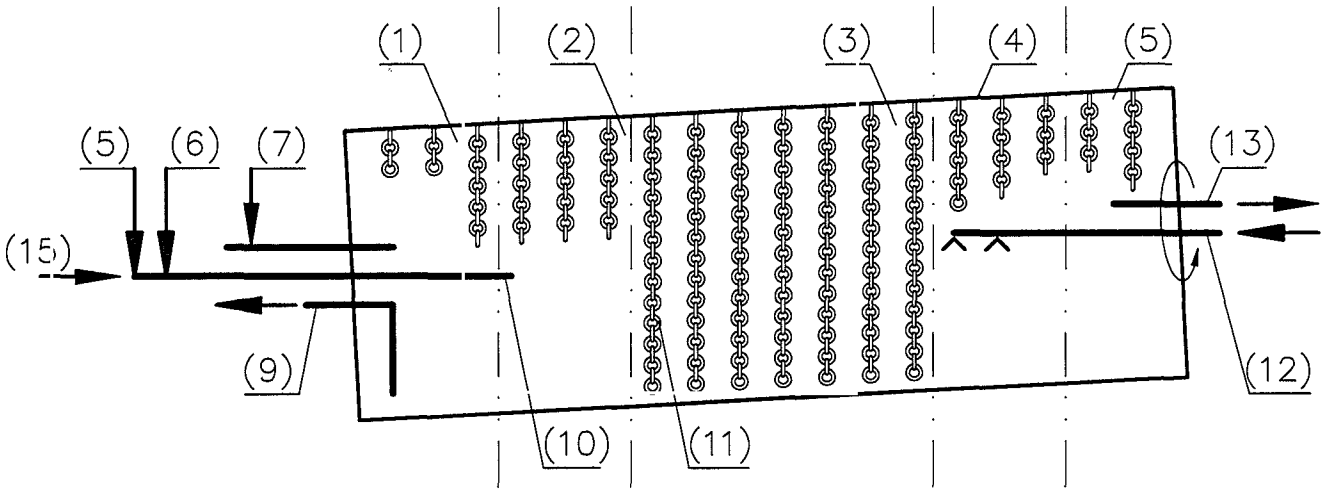
FIG. 2 is a schematic view of the direct contact rotating steam generator of the present invention, with internal combustion.

FIG. 2 shows a reaction chamber apparatus of a rotating steam generator that includes internal combustion. The fuel 6 can be coal slurry, hydrocarbons such as untreated heavy low quality crude oil, VR (vacuum residual), asphaltin, petcoke or any available carbon or hydrocarbon fuel. The oxidizer gas 6 can be oxygen, enriched air or air. Water 15 can be injected to the combustion chamber 2 to control high temperatures and preventing structural damage. The fuel 6 and oxidizer 5 are injected directly to the pressurized combustion chamber 2. Portion of the oxidizer possibly with produced gas 13 can be recycled and injected 7 to reduce the temperature in the solids discharge section 1.

The connection of the injection and discharge pipes to the reactor is through a swivel connection connecting the rotating vessel to the stationary pipes. Such swivel rotatable and sealed connections are commercially available. The temperature in combustion area 2 is more than 900° C. and preferably in the range of 1200-1300° C., to minimize the amount of unburned carbons in the slag for any particular fuel in use. The combustion section 2 in the vessel contains high-alloy heat resistance chains and is coated with thermal resistance material that can withstand such high-temperature conditions. Water can be injected into combustion area 2 to maintain a controlled high temperature, preventing damage to the facility while achieving a full oxidation reaction of the fuel.

The following products are injected into the opposite side of the sloped vessel, where they are then converted to steam and solids: Low quality water 12, (with high solids contamination, like silica clay from settlement pond), totally dissolved solids, organic materials (such as tar, heavy oil, biologically-contaminated sewage and any similar waste water). The liquids and the solids that were carried with the water 12 move down the sloped rotating vessel to solid discharge location 9, close to the vessel wall at the discharged section 1. The combustion gases and the liquid move in opposite directions. The combustion gases move upwards to discharge section 5 and the liquids and solids move down the sloped rotating vessel to solid or slurry discharge section 1. The counter-flow increases the heat transfer and reduces the vessel length compared to a parallel flow option. Low temperature gas, like oxidizing gas or recycled produced gas 13 can be injected to discharge section 1 to recover heat and reduce the discharge solids temperature.

The vessel is partially filled with free moving chains 11. The chains serve as heat transfer elements and as a regenerating surface for removing solid deposits. Section 3 is the main heat transfer section, where heat is transferred from the combustion gases to the liquids and the solids at the bottom of the rotating vessel.

The gas mixture, mainly steam, $CO_2$, $N_2$, smaller percentages of other impurities and remaining fly solids are discharged at the opposite elevated side of the vessel 1 3 in discharge section 5.

Figure 3:
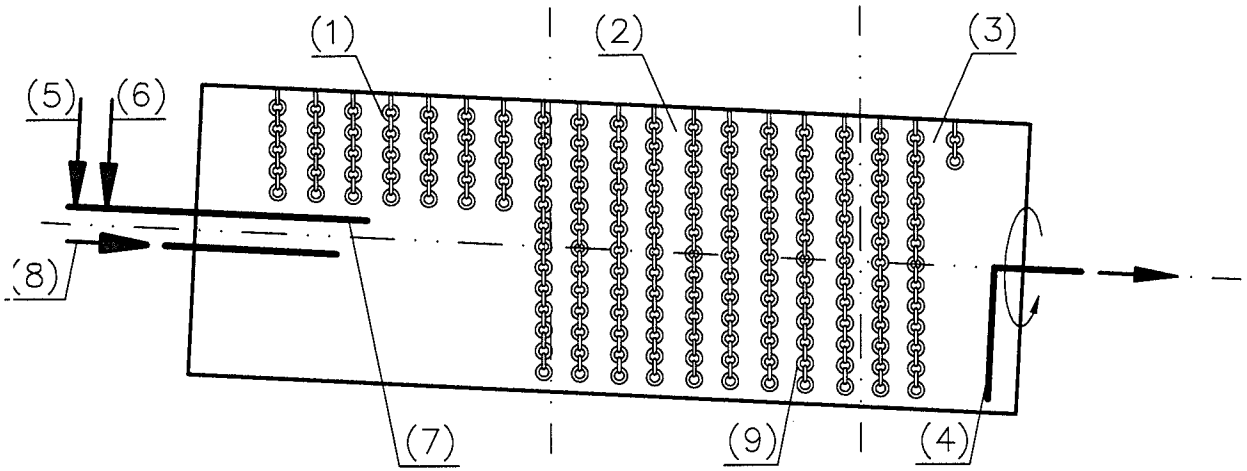
FIG. 3 is a schematic view of another direct contact steam generator with parallel flow.

FIG. 3 shows a reaction chamber apparatus of a rotating steam generator that includes internal combustion and parallel flow. The fuel 6 can be any available carbon or hydrocarbon fuel. The oxidizer gas 5 can be oxygen, enriched air or air. Water 8 can be injected to the combustion chamber 1 to control high temperatures and prevent structural damage. The fuel 6 and oxidizer 5 are injected directly to the pressurized combustion chamber 1.

The temperature in combustion reaction in area 2 is more than 900° C. and preferably in the range of 1200-1300° C., to minimize the amount of unburned carbons in the slag for any particular fuel in use. The combustion section 1 in the vessel is coated with thermal resistance material that can withstand these high temperature conditions. Low quality water 8 with high solids contamination, like silica clay, totally dissolved solids, and possibly organic materials, such as tar, heavy oil, biologically-contaminated sewage and any similar waste water, is injected to the combustion side of the sloped vessel where it is used to control the combustion temperature while being converted to steam and solids or high concentration slurry. The liquids and solids that were carried with water 8 moves down the sloped rotating vessel. It goes into the homogenizer and steam generation section 2. Section 2 is partially filled with chains that increase the heat transfer between the combustion gas and the liquid phase on the bottom of the rotating drum. The free-moving chain also removes solids build-up. The discharge section 3 is located at the low point of the sloped rotating pressure drum. There is a single discharge point coming from the pressurized direct-contact steam generator. The produced steam, flue gas mixture and the produced solids or slurry are discharged from 4, located at the lowest point of the sloped vessel close to the rotating wall.

Figure 4:
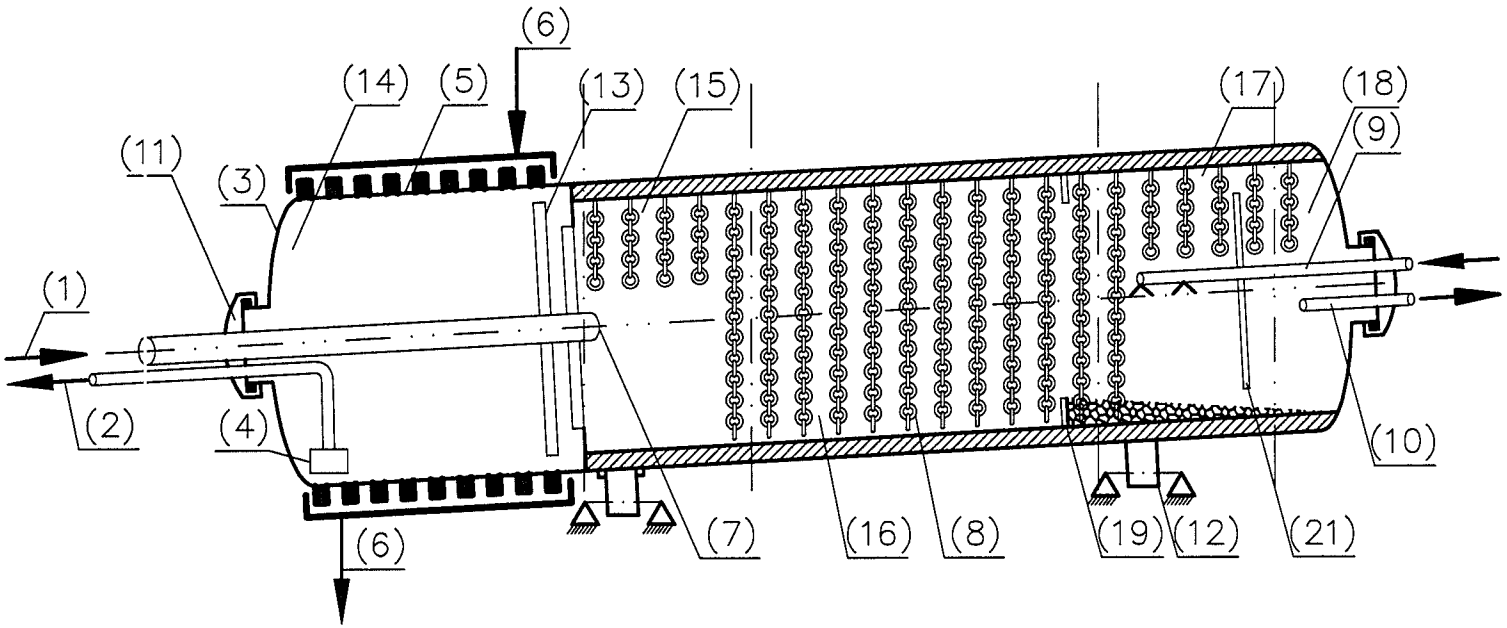
FIG. 4 is a schematic view of an alternate embodiment of the reaction chamber of the direct contact steam generator with counter-flow rotating drum with separation and a cooling discharge section.

FIG. 4 shows a counter-flow reaction chamber, where the hot pressurized combustion gases used for generating the steam are generated in a separate gasifier or pressurized boiler (not shown). Hot pressurized combustion gases 1 are supplied to the combustion gas supply section 15 through a swivel connection 11. This allows the pressurized drum to rotate freely. The combustion gas temperature may be between 350° C.-1000° C. and the pressure can vary from 2 bar to 100 bar, as required by a particular EOR facility. The combustion gas supplied in section 15 is partially separated from the solids discharge section 14 with stationary separation walls 13. The solids discharge section 14 of the rotating vessel is continually cooled. Heat is continually transferred from the vessel's wall 5 at the discharge section. The heat can be used to pre-heat liquid or gas flow 6 for use elsewhere in the EOR process. The discharged solids 2 can be in a dry-particles form or in a slurry form for cost-effective disposal in a land-fill. The rotating pressurized vessel 3 is slightly inclined and the solids discharge section is at a lower location. The water injection in the opposite side at section 18 at a high location in the sloped vessel. The solid discharge from collector 4. The collector is located close to the bottom of the rotating vessel wall. The rotating vessel is partially filled with chains 8. The chains act as heat transfer elements and remove the solid deposits. Each chain connects to an internal vessel wall, at least at one end and possibly connected at two ends at an angle to the rotating axis. This is done to improve the liquid and solids circulation in the rotating vessel. Most of the heat transfers and steam generation occur at section 16. It is partially filled with chains that are designed to improve steam generation and mix the counter-flow gas and liquid streams to generate a homogenized dry gas mixture. Liquid water 9 injected in section 17 of the steam generator. There, liquid flow in the rotating drum is controlled by partition 19 that controls liquid level 20 at the water injection section. At this section the liquids are heated with a stream of counter-flow, steam rich gas, where the rotating chains increase the rate of heat transfer. The liquids and the wet chains also help in capturing the fly-solids dust carried by the produced steam and recycling it back to the sloped rotating vessel, bringing it to the solids discharge section 14. The water injection section 17 is partly separated by stationary partition 21 located on the water injection pipe 9. This pipe partly separates the water injection section 17 and the steam and gas discharge section 18. The produced steam and gas 10 is discharged from steam discharge section 18. The rotating drum is supported on rotating supports 12 that control the rotation speed. The rotation speed is between 40 and 180 rounds per hour.

Figure 5:
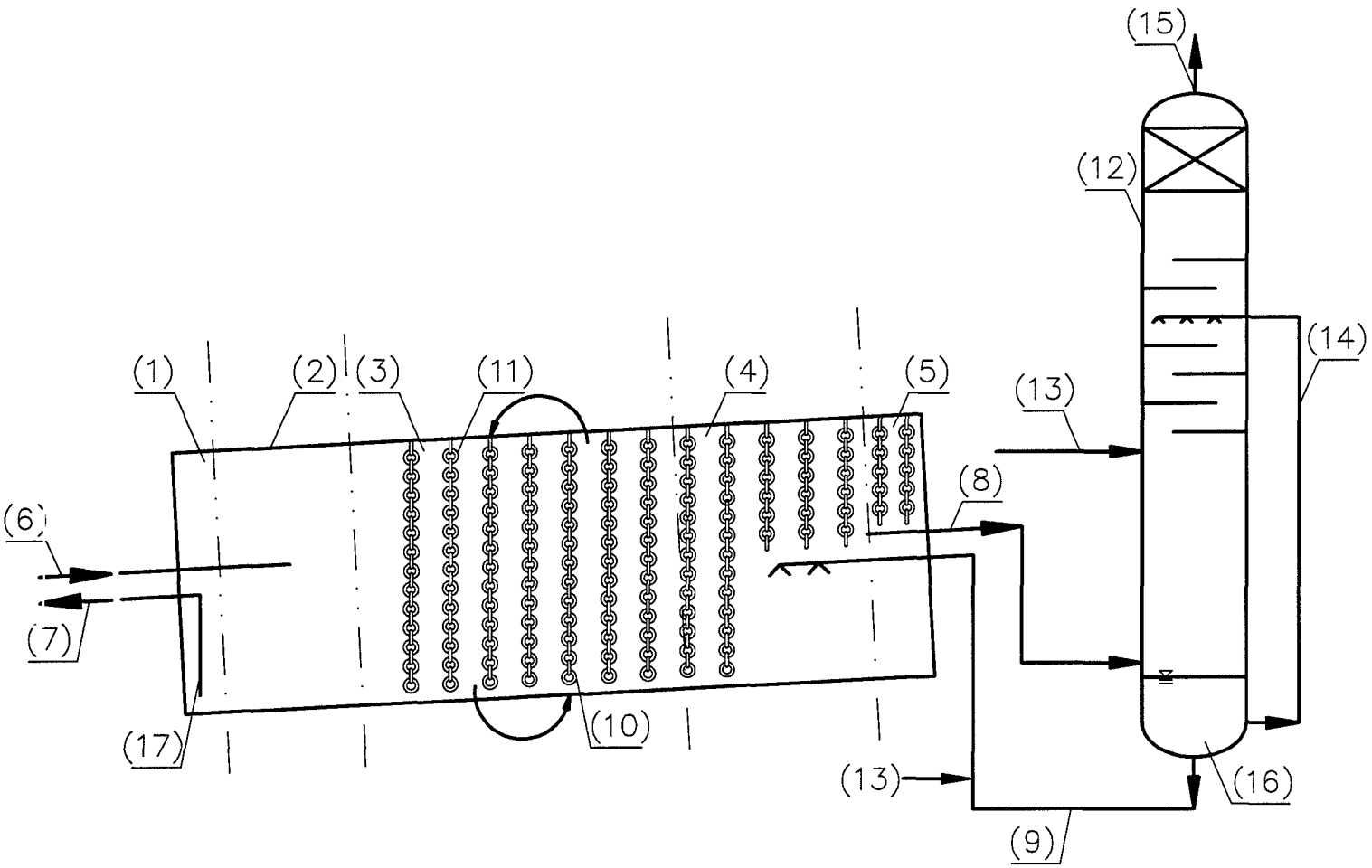
FIG. 5 is a schematic view of the reaction chamber of the direct contact rotating steam generator connected to a vertical vessel for saturated steam generator and wet solid scrubbing with solid-rich water recycled back to the rotating steam generator.

FIG. 5 shows a rotating direct-contact steam generator for the production of pressurized steam and flue gas mixture, with zero liquid waste discharge. Rotating counter-flow horizontally-sloped pressure drum 11 is partly filled with chains 10. The chains are connected to the internal drum wall and they are free to move inside the drum. The drum 11 is a pressurized vessel and is continually rotating. The rotating speed is relatively slow, so no centrifugal force is generated. The speed is typically between 40 and 180 RPH. Energy 6 is supplied at the low point of the sloped pressure drum 11. The energy can be supplied in the form of hot combustion gases generated by a separate unit (not shown) like a pressurized boiler (like PFB-Pressurized Fluidized Bed Boiler) or as a mixture of oxidizer and fuel. This mixture will be combusted inside the rotating vessel. The fuel can be any gas, liquid or solid, containing carbons like hydrocarbon gas, carbon monoxide. It can also contain liquid hydrocarbons (like heavy oil or solids) or carbons like petcoke slurry, coal slurry or any available carbon fuel. The oxidizer is a gas which contains oxygen. It can be air, oxygen or enriched air. The pressure inside the rotating drum can vary between 2 bar and 100 bar, according to the EOR facility requirements.

The rotating vessel 11 is comprised from several sections. Section 1 is the solid discharge section and it is located at the lower vessel section. The solids or high concentration slurry move to the discharge point due to the sloped rotating drum. The solids in dry or slurry form are collected by a static (not rotating) collector 17, located near the lower point close to the vessel wall. The solids with carrying gases 7 are released from vessel 11 at high pressure for further processing, such as de-pressurized, separation and gas recover, heat recover and disposal.

The energy is introduced into the steam generator in section 2. This can be done by using external combustion, where high-temperature combustion gases 6 are injected into it, or by internal combustion of injected fuel and oxidizer in section 2.

Section 3 completes the steam generation using solid-rich feed water. At the bottom of section 3, at the line that separates section 3 from section 2, the transformation of the liquid water to steam is completed. The solids carried by the water, remain on the bottom of the rotating drum in dry form. The heat exchange that occurs between the gases and the solid rich liquids is increased by the use of chains 10 that maintain close contact both with the hot combustion gas and with the liquids at the bottom of the rotating vessel. The solid deposits left by the fuel combustion and from the water TSS and TDS settle on the exposed surfaces, mainly the surface area of the chains 10. Due to rotating movement, the chains regenerate their surface area and remove solids and slurry deposits from the rotating drum 11 walls.

The water, like mature tailing pond water, with high levels of TDS and TSS is injected to section 4. The injected water in this section collects flying dust from the flowing steam and flue gas mixture that flows to discharge section 5. The heat transfer between the water and the hot gas starts at this section, where chains increase the heat transfer between the different phases. The produced steam and non-condensable combustion gases 8 are discharged from section 5. The produced gas mixture flows to vertical vessel 12. The excess heat, as well as the carry-on flying solids are scrubbed and washed by the saturated water 16 in scrubber 12 where additional steam is generated to produce saturated steam 15. Water 13 is continually injected to vessel 12 to replace the water that was previously converted to steam. Some water 13, especially if it contains organics or extremely high level of solids, can be injected directly to the rotating steam generator 11. Solid rich water that contains the scrubbed solids 9 are continually discharged from vessel 12 and recycled back to the rotating steam generator 11. To remove SO2, line can be added to the liquid water in vessel 12. The product is a solid-free saturated mixture of steam and non condensable combustion gases for EOR (Enhanced Oil Recover).

Figure 6:
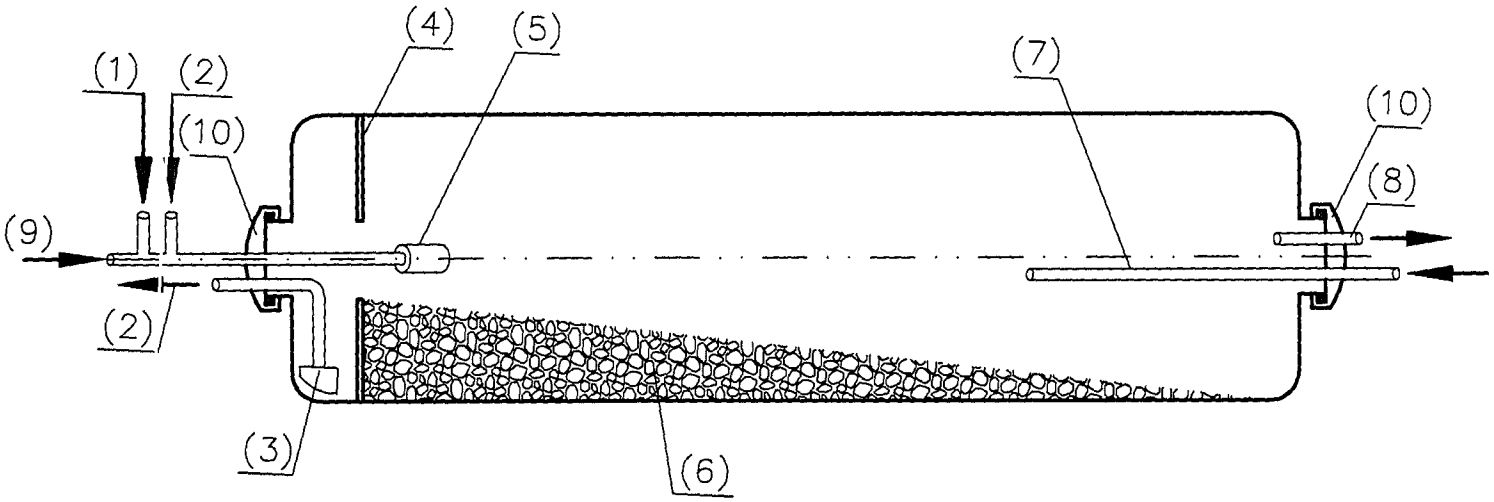
FIG. 6 is a schematic view of another alternate embodiment of a reaction chamber of the direct-contact steam generator with combustion section. It includes counter flow and is partially filled with free spherical bodies.

FIG. 6 shows a rotating steam generator that includes spherical bodies. The fuel 1 can be any available carbon fuel. The oxidizer gas 2 can be oxygen, enriched air or air. Water 9 can be injected to the combustor to control the temperature, preventing structural damage. The fuel and oxidizer are injected to the combustion chamber through fixed pipes while the vessel rotates. The connection 10 seals the pipes going into the reactor, as the pressure inside the combustion chamber is high as required by the produced steam. The slow rotation seal units 10 are commercially available. To avoid leakage, high-quality, clean water can be used as part of the sealed design, as the high pressure seal medium and cooling fluid where some water will enter the reactor. The temperatures in the combustion section are significantly higher than those of the rest of the steam generator process, as they are driven by the typical fuel combustion (and not by steam generation). The combustion temperature is at the range of 700-1300° C. for low-slag fuel. The temperature will minimize the amount of unburned carbons in the slag for the particular fuel in use. Low-quality water 7 is injected through to the opposite side of the sloped vessel. This water may have high solid content. For example, it may contain silica clay, be high in total dissolved solids and possibly have high organics contamination like tar, heavy oil, biologic contaminated sewage and any similar waste water. Due to the slope, the liquid flows in the opposite direction to the combustion gas flow, thus improving the heat transfer. The bottom of the vessel is partially filled with free rotating spherical bodies 6. The solids are attracted to the spherical bodies due to their mass and gravitational force. The low-quality injected water 7 evaporates and reduces the temperature of the spherical bodies to less than 850° C. It generates the steam in the rotating reactor, where the round element grinds the remaining solids and keeps the vessel and its surface clean. The liquids go into a gas phase and then become ground-up solid particles (waste matter). At the lower side of the rotating vessel, there is a separation wall 4, that keep the spherical bodies 6 from the solid discharge collector 3. The separation wall allows the flow of the ground solids 11 to enter the solid discharge collector 3, located at the lower point of the pressure vessel close to the rotating drum wall. The mixture of gas, mainly steam, $CO_2$, and N2 and possibly smaller percentages of other impure gases is discharged along with the remaining solids 8 at the opposite elevated side of the vessel.

Figure 7:
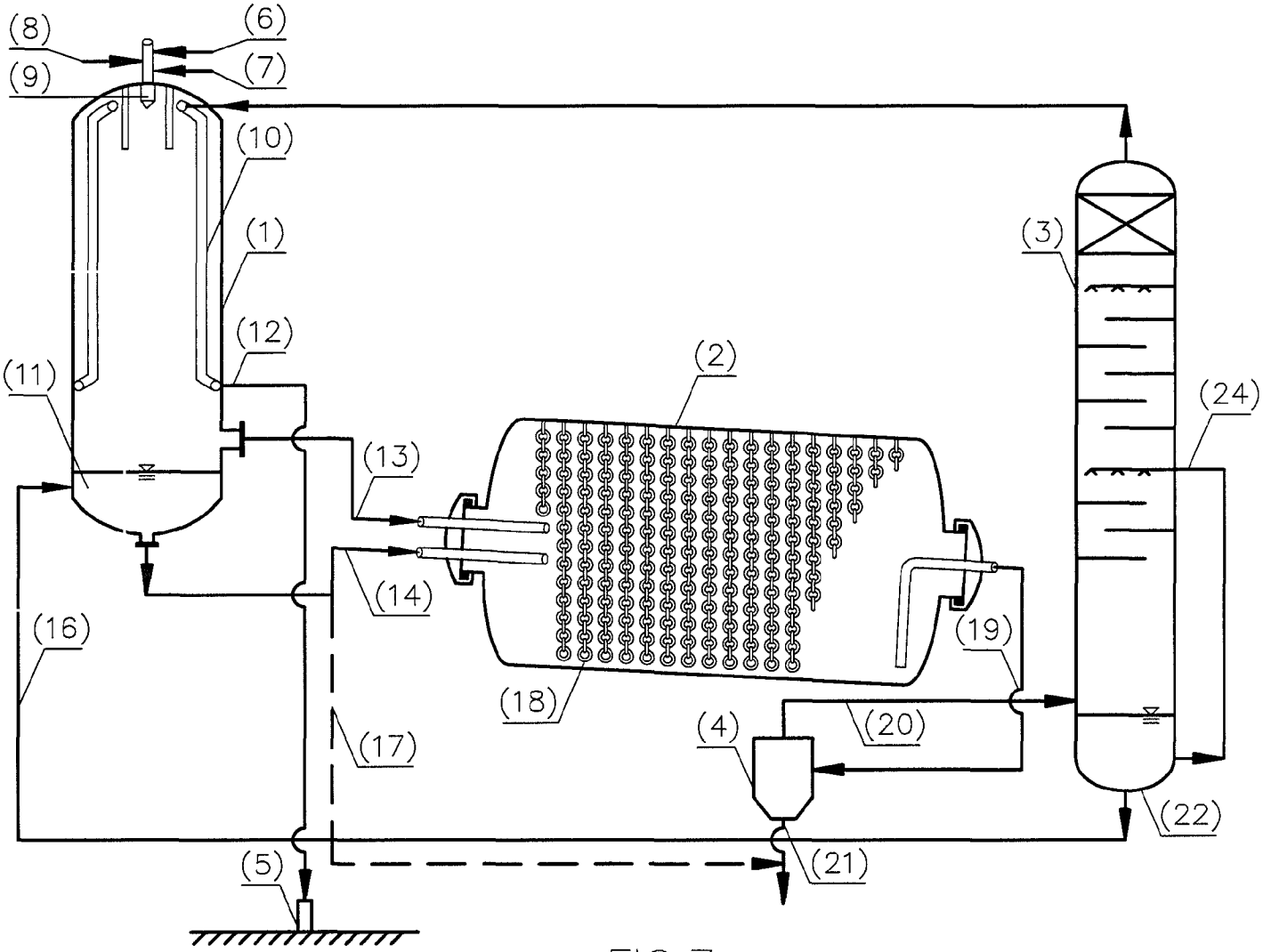
FIG. 7 is another schematic view of the reaction chamber of the direct contact rotating steam generator, wherein a pressurized gasifier type combustor is connected to the rotating direct contact steam generator. This is then connected to a solids removal section and combined with a wet scrubbing section with saturated steam generator. The saturated mixture is then heated in the heat exchanger of the combustor to produce a superheated dry mixture.

FIG. 7 shows an integrated system of parallel flow rotating reaction chamber with separate stationary combustion chambers, vertical saturated steam tower and injection well for injecting the produced steam. A down-flow pressurized combustor 1, similar to the Texaco gasifier design with cylindrical heat exchanger 10 and quenching bath combust Carbon fuel 6 with oxidizing gas 7 and possibly water 8 to keep the temperature under control. At the bottom of the combustor, there is a quenching water bath 11 to collect the generated solids and char. The pressure in the system can vary from 5 bar to 100 bar as required for EOR. The combustion gases 13 are injected to a rotating direct-contact parallel flow steam generator 2. The heat transfer efficiency with the parallel flow rotating reactor is less effective when compared to the counter flow rotating reactor. It will be used where the water contains high levels of dissolved salts with low sublimation temperature. The gases' temperature can be in the range of 400 to 1300° C. Solid rich water 11 from the quenching bath is continually discharged to the rotating steam generator. The quenching water 11 temperature is slightly less than the saturated water temperature, typically in the range of 90-300° C. The gas and water is injected at the elevated side of the rotating steam generation drum 2. The rotating steam generator is partly filled with chains 18 that increase the heat transfer and prevent solids build-ups. The discharge flow is collected at the low point in the rotating vessel, close to the vessel wall. The discharge is a mixture of gas and solids, the solids can be in a form of slurry after most but not all the liquids are converted to steam in the rotating steam generator 2. The high concentrated solids are separated in a commercial available gas-slurry separation facility 4. The slurry minimized the generated dust. After the slurry is removed, the gas flow 20 flows to the vertical vessel where it is mixed with saturated water 24. The solid remains, together with gas flow 20, are washed from the gas in vertical vessel 3. Additional make-up water 23 is added to maintain the designed water level in vessel 3. Solid-rich water 16 from vessel 3 is continually recycled back to the quenching bath of combustor 1. To remove $SO_2$, lime can be added to the saturated scrubbing water 22. Vertical tower 3 generates a saturated steam and non-condensed combustion gas mixture 25. The saturated gas flow can be condensed to recover the water and as a heat source (not shown) for the process like for generating boiler feed water (like in Multi Effect Distillation facility). The gasifier 1 can be used to generate a dry, super heated steam or steam and gas mixture. The steam is injected through wellhead 5 to an underground formation for EOR.

Figure 8:
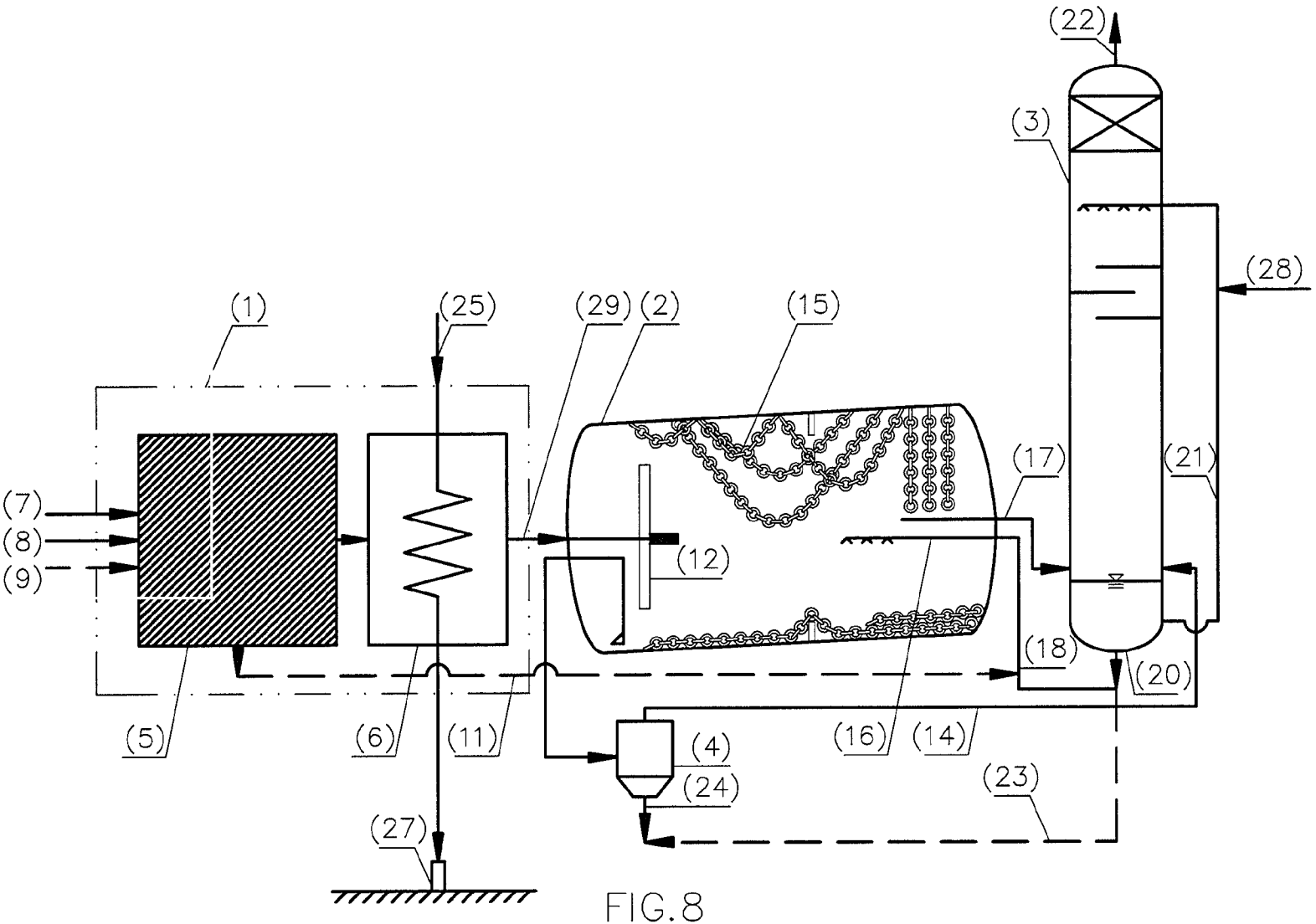
FIG. 8 is a schematic view of another alternate embodiment of the reaction chamber of the counter-flow direct contact rotating steam generator. It shows a basic steam boiler, a dry solid discharge and a wet scrubber, with a saturated steam generator.

FIG. 8 shows an integrated system of rotating direct-contact steam generator for the production of steam and combustion gas mixture, with zero liquid discharge. Rotating counter-flow horizontally-sloped pressure drum 2 is partly filled with chains 15. The chains are connected to the internal drum wall and they are free to move inside the drum. The drum 2 is a pressurized vessel and is continually rotating. The rotating speed is relatively slow, so no centrifugal force is generated. The rotating speed is typically between 40 and 180 RPH. Energy 29 in the form of hot combustion gas is supplied at the low point of the rotating drum 2. The energy supplied from a pressurized gasifier or steam boiler facility 1 with combustion section 5 and heat exchanging for steam generation section 6. The combustion section 5 combust Carbon fuel 7 with oxidizing gas 8 and possibly water 9. In one embodiment the combustion includes quenching water where some quenching water discharged from the combustor 11 and recycled to the rotating steam generator 2. The combustion can be complete (stoichiometric fuel-oxygen ratio) or partial. For partial combustion, the syngas is recovered from the discharge 22. The combustion pressure in the system can vary from 5 bar to 30 bar. The steam generated in the heat exchanger 6 and its pressure can be in the range of 10 bar to 100 bar as required for EOR. The combustion gases 29 are injected to a rotating direct-contact counter flow steam generator 2. The gases' temperature can be in the range of 400° C. to 1300° C. Solid rich water 18 is injected at the elevated side of the rotating steam generation drum 2. Produced Gas 17 is discharged at the elevated side of the rotating drum. The water injected to the rotating vessel maintained in a liquid form at the water injection section by a separation wall attached to the rotating drum. The rotating steam generator is partly filled with chains 15 that increase the heat transfer and prevent solids build-ups. The hot gas injection section and the dry solids collection section are separated by a separation wall 12. The discharge solids flow is collected at the low point in the rotating vessel, close to the vessel wall. The dry solids or high concentration slurry are separated in a commercial available cyclone based or other type of separation facility 4 to separate the gas-solid or the gas-slurry flow. After most of the solids are removed, the solids lean gas flow 14 flows to the vertical vessel where it is mixed with saturated water 20. Additional saturated steam 22 is generated, due to the heat transfer from the gas 17 to the saturated water 20. The solid remains, together with gas flow 17, are washed from the gas in vertical vessel 3. Additional make-up water 28 is added to maintain the designed water level in vessel 3. Solid-rich water 18 from vessel 3 is continually recycled back to the rotating steam generator 2. To remove SO2, lime can be added to the saturated scrubbing water 20. Vertical tower 3 generates a saturated steam and non-condensed combustion gas mixture 22. The dry superheated steam generated by facility 1 from boiler grade water or from saturated steam is injected through wellhead 27 to an underground formation for EOR.

Figure 9:
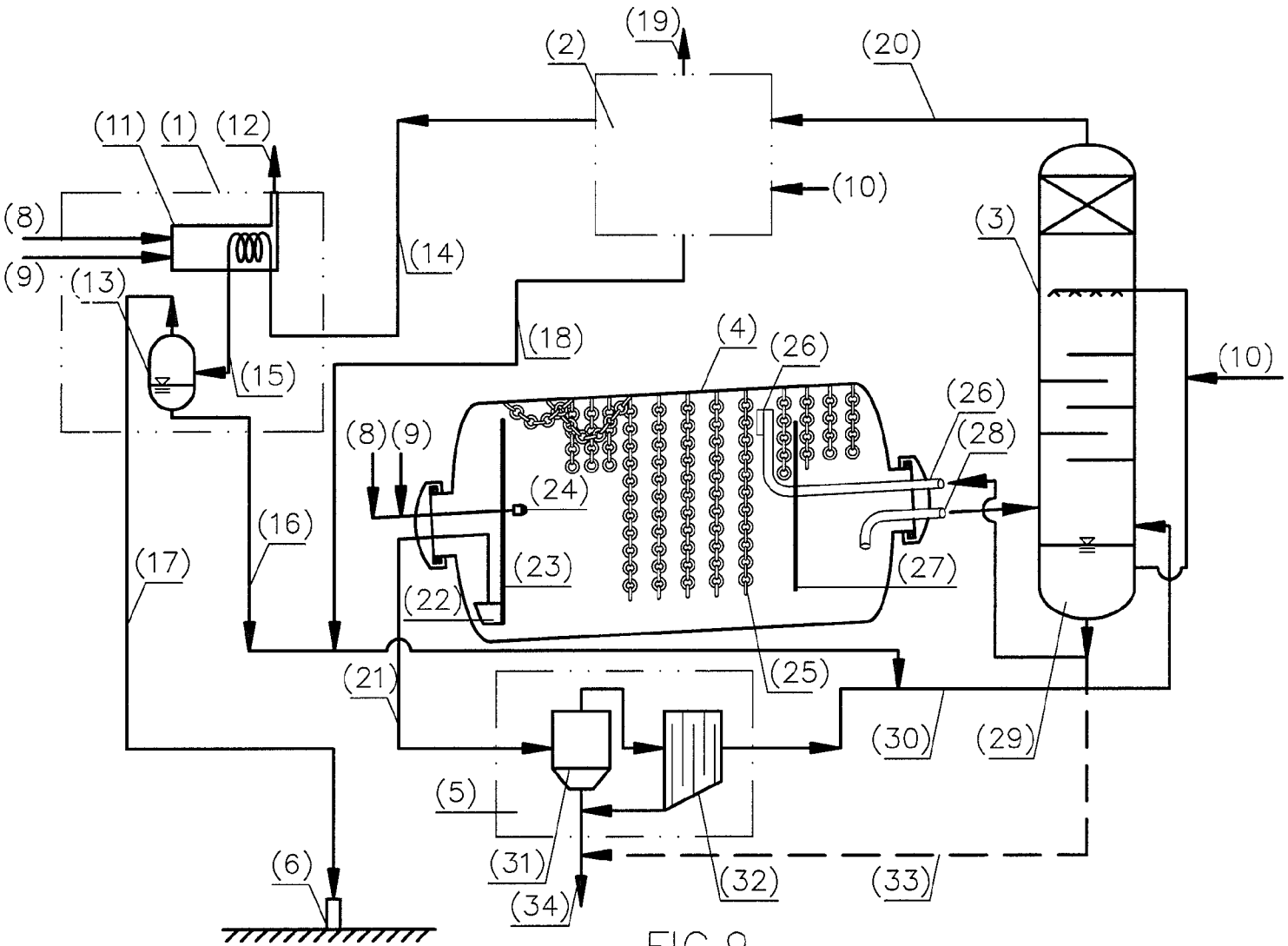
FIG. 9 shows an integrated system of the direct contact steam generator with an existing steam generation facility and water recovery unit.

FIG. 9 shows a rotating direct-contact steam generator for the production of steam from low grade disposal water, with zero liquid waste discharge and indirect steam generation facility. Prior-art commercially available non-direct steam generation facility 1 produces steam from treated steam production grade water 14. The facility can include steam boilers or OTSG (Ones Trough Steam Generation) 11. Fuel 8 and oxidizer 9 combusted at atmospheric pressure generating steam 15 and flue gas 12. The steam is separate with pressure drop 13 to produce high pressure steam 17. The steam is injected through injection well 6 for EOR. The produce steam pressure is in accordance with the oil formation pressure. Blow-down water 16 continually generated by the steam generation facility 1. The blow down disposal water 16 from existing facility 1 injected to vessel 3 or directly to the rotating steam generator 4.

Rotating counter-flow horizontally-sloped pressure drum 4 is partly filled with chains 25. The chains are connected to the internal drum wall and they are free to move inside the drum. The drum 4 is a pressurized vessel and is continually rotating. The rotating speed is relatively slow, so no centrifugal force is generated. Energy 24 is supplied at the low point of the sloped pressure drum 4. The energy supplied in as a mixture of oxidizer 8 and fuel 9. This mixture will be combusted inside the rotating vessel 4. The fuel 8 can be any gas, liquid or solid, containing carbons like hydrocarbon gas, carbon monoxide. It can also contain liquid hydrocarbons (like heavy oil or solids) or carbons like petcoke slurry, coal slurry or any available carbon fuel. The oxidizer is a gas which contains oxygen. It can be air, oxygen or enriched air. The pressure inside the rotating drum can vary between 2 bar and 100 bar.

The rotating vessel 11 is comprised from several sections. The solids 21 move to the discharge point 22 due to the sloped rotating drum. The solids are collected by a static (not rotating) collector 22, located near the lower point close to the vessel wall. The solids with carrying gases 21 are released from vessel 4 at high pressure for solid separation, de-pressurized and disposal. The solids are separated using a commercial available solid-gas separation package 5. The package can include a cyclone separator 31, electrostatic dust collector 32 or any other commercial available solid separation unit. The solids discharge for disposal 34 through commercial available de-pressurizes chamber system (not shown). For dust control low quality water 33 may be sprayed or added to the dry solid waste. The solid waste disposed in landfill. The solid lean gas 30 can be released to the environment (not shown) or injected to pressurized tower 3 where it is mixed with saturated water to recover its heat and remove the fly solids remains.

The energy is introduced into the steam generator in the second section by internal combustion of injected fuel and oxidizer 24. The combustion section is partly separated from the solid discharge section by partition wall 23. The combustion gases flows upstream the rotating sloped vessel to the third Section to generate steam from the solid rich water. The solids carried by the water, remain on the bottom of the rotating drum in dry form. The heat exchange that occurs between the gases and the solid rich liquids is increased by the use of chains 25 that maintain close contact both with the hot combustion gas and with the liquids at the bottom of the rotating vessel. The solid deposits left by the fuel combustion and from the water TSS and TDS settle on the exposed surfaces, mainly the surface area of the chains 25. Due to rotating movement, the chains regenerate their surface area and remove solids deposits from the rotating drum 4 walls.

The water with high levels of TDS and TSS 26 is injected to fourth section in rotating drum 4. The injected water in this section collects part of the flying dust from the flowing steam and flue gas mixture that flows to the fifth section. The fourth and fifth sections are partly separated by partition 27. The heat transfer between the water and the hot gas starts at this section, where chains increase the heat transfer between the different phases. The produced steam and non-condensable combustion gases 28 are discharged from the fifth section. The produced gas mixture flows to vertical vessel 3. The excess heat, as well as the carry-on flying solids are scrubbed and washed by the saturated water 29 where additional steam is generated to produce saturated steam 20. Water 10 is continually injected to vessel 3 to replace the water that was previously converted to steam or recycled back 26 to the rotating steam generator. Solid rich water that contains the scrubbed solids 26 are continually discharged from vessel 3 and sent back to the rotating steam generator 4. To remove $SO_2$, lime can be added to the liquid water in vessel 3.

The produce mixture of solid-free steam and non-condensable gas 20 flows to facility 2 for recover its energy and generate pre-heated boiler feed water. Water 10 supplied to facility 2. The facility produces medium temperature, high pressure boiler feed water stream 14. A stream of discharged water 18 produces by facility 2 is recycled into vessel 3 or directly to rotating steam generator 4. Non Condensable Gas 19 rich with Carbone dioxide can be further processed for $CO_2$ recover or sequestration. The high pressure pre-heated boiler feed water 14 is supplied for the steam generation facility 1 for generating the EOR steam.

EXAMPLE 1

The following flow table is a simulation of a rotating direct-contact steam generator, as described in FIG. 3 for 50 bar underground formation pressure EOR. The simulated flow shows flow 4 being discharged from the pressurized rotating drum discharge section 3. The heat source is coal slurry, internally combusted. The water source is settlement pond water. The discharged steam, flue gas and solids mixture is described in the following table:

| Connected to [In\|Out] | /Reactor_Outlet.Out /CX-01.In0 |
|---|---|
| VapFrac | 0.98553 |
| T [C] | 400.0 |
| P [kPa] | 5965.00 |
| MoleFlow [kgmole/h] | 545.42 |
| MassFlow [kg/h] | 11722.72 |
| VolumeFlow [m3/hr] | 504.569 |
| StdLiqVolumeFlow [m3/hr] | 12.264 |
| StdGasVolumeFlow [SCMD] | 3.1011E+5 |
| Properties | |
| Energy [W] | −3.803E+7 |
| H [kJ/kmol] | −250980.7 |
| S [kJ/kmol-K] | −39.876 |
| MolecularWeight | 21.49 |

-continued

| | |
|---|---|
| MassDensity [kg/m3] | 23.2331 |
| Cp [kJ/kmol-K] | 38.072 |
| ThermalConductivity [W/m-K] | 0.0752 |
| Viscosity [Pa-s] | 8.2892E+24 |
| molarV [m3/kmol] | 0.925 |
| ZFactor | 0.9860 |

| Mole | [Fraction] | [kgmole/h] |
|---|---|---|
| WATER | 0.87201 | 475.62 |
| CARBON DIOXIDE | 0.10397 | 56.71 |
| CARBON MONOXIDE | 0.00505 | 2.76 |
| OXYGEN | 0.00227 | 1.24 |
| HYDROGEN | 0.00108 | 0.59 |
| ARGON | 0.0011 | 0.60 |
| NITROGEN | 0.00059 | 0.32 |
| ExampleFeedCoal* | 0.00 | 0.00 |
| gALUMINUM OXIDE | 0.00181 | 0.98 |
| gCALCIUM OXIDE | 0.00088 | 0.48 |
| gDIIRON TRIOXIDE | 0.00051 | 0.28 |
| gMAGNESIUM OXIDE | 0.00038 | 0.21 |
| gMANGANESE OXIDE | 0.00 | 0.00 |
| gDISODIUM OXIDE | 0.0002 | 0.11 |
| gSILICON DIOXIDE | 0.00804 | 4.39 |
| AMMONIA | 0.00047 | 0.25 |
| HYDROGEN CYANIDE | 0.00021 | 0.11 |
| CARBONYL SULFIDE | 0.00014 | 0.08 |
| HYDROGEN SULFIDE | 0.00 | 0.00 |
| METHANE | 0.00 | 0.00 |
| ETHYLENE | 0.00 | 0.00 |
| ETHANE | 0.00 | 0.00 |
| PROPANE | 0.00 | 0.00 |
| n-BUTANE | 0.00 | 0.00 |
| SULFUR DIOXIDE | 0.00129 | 0.70 |

| Mass | [Fraction] | [kg/h] |
|---|---|---|
| WATER | 0.73092 | 8568.35 |
| CARBON DIOXIDE | 0.2129 | 2495.79 |
| CARBON MONOXIDE | 0.00658 | 77.17 |
| OXYGEN | 0.00338 | 39.62 |
| HYDROGEN | 0.0001 | 1.19 |
| ARGON | 0.00204 | 23.92 |
| NITROGEN | 0.00076 | 8.95 |
| ExampleFeedCoal* | 0.00 | 0.00 |
| gALUMINUM OXIDE | 0.00857 | 100.42 |
| gCALCIUM OXIDE | 0.00229 | 26.82 |
| gDIIRON TRIOXIDE | 0.00382 | 44.76 |
| gMAGNESIUM OXIDE | 0.00072 | 8.41 |
| gMANGANESE OXIDE | 0.00 | 0.00 |
| gDISODIUM OXIDE | 0.00058 | 6.83 |
| GSILICON DIOXIDE | 0.02248 | 263.56 |
| AMMONIA | 0.00037 | 4.34 |
| HYDROGEN CYANIDE | 0.00026 | 3.06 |
| CARBONYL SULFIDE | 0.00039 | 4.62 |
| HYDROGEN SULFIDE | 0.00 | 0.00 |
| METHANE | 0.00 | 0.00 |
| ETHYLENE | 0.00 | 0.00 |
| ETHANE | 0.00 | 0.00 |
| PROPANE | 0.00 | 0.00 |
| n-BUTANE | 0.00 | 0.00 |
| SULFUR DIOXIDE | 0.00383 | 44.92 |

| StdLiqVolume | [Fraction] | [m3/hr] |
|---|---|---|
| WATER | 0.69936 | 8.577 |
| CARBON DIOXIDE | 0.24939 | 3.059 |
| CARBON MONOXIDE | 0.02066 | 0.253 |
| OXYGEN | 0.00728 | 0.089 |
| HYDROGEN | 0.003 | 0.037 |
| ARGON | 0.00361 | 0.044 |
| NITROGEN | 0.00229 | 0.028 |
| ExampleFeedCoal* | 0.00 | 0.000 |
| gALUMINUM OXIDE | 0.00198 | 0.024 |
| gCALCIUM OXIDE | 0.00065 | 0.008 |

EXAMPLE 2

The following flow table is a simulation of a rotating direct-contact steam generator as described in FIG. 5 for 50 bar underground formation pressure EOR. The simulated flow is flow 15 discharged from the vertical vessel 12, that is connected to rotating pressurized drum 11. The heat source was coal slurry that underwent external combustion. The water source was settlement pond water. The discharged steam, flue gas and solids mixture is described in the following table:

| Connected to [In\|Out] | /SX-01.Vap /H1.In |
|---|---|
| VapFrac | 1.00 |
| T [C] | 268.6 |
| P [kPa] | 5965.00 |
| MoleFlow [kgmole/h] | 548.00 |
| MassFlow [kg/h] | 11398.53 |
| VolumeFlow [m3/hr] | 413.815 |
| StdLiqVolumeFlow [m3/hr] | 12.247 |
| StdGasVolumeFlow [SCMD] | 3.1158E+5 |
| Properties | |
| Energy [W] | −3.756E+7 |
| H [kJ/kmol] | −246771.7 |
| S [kJ/kmol-K] | −47.896 |
| MolecularWeight | 20.80 |
| MassDensity [kg/m3] | 27.5450 |
| Cp [kJ/kmol-K] | 36.585 |
| ThermalConductivity [W/m-K] | 0.0573 |
| Viscosity [Pa-s] | 1.8985E−5 |
| molarV [m3/kmol] | 0.755 |
| Zfactor | 1.0000 |

| Mole | [Fraction] | [kgmole/h] |
|---|---|---|
| WATER | 0.88696 | 486.05 |
| CARBON DIOXIDE | 0.10122 | 55.47 |
| CARBON MONOXIDE | 0.00496 | 2.72 |
| OXYGEN | 0.00224 | 1.23 |
| HYDROGEN | 0.00105 | 0.57 |
| ARGON | 0.00108 | 0.59 |
| NITROGEN | 0.00058 | 0.32 |
| ExampleFeedCoal* | 0.00 | 0.00 |
| gALUMINUM OXIDE | 0.00 | 0.00 |
| gCALCIUM OXIDE | 0.00 | 0.00 |
| gDIIRON TRIOXIDE | 0.00 | 0.00 |
| gMAGNESIUM OXIDE | 0.00 | 0.00 |
| gMANGANESE OXIDE | 0.00 | 0.00 |
| gDISODIUM OXIDE | 0.00 | 0.00 |
| gSILICON DIOXIDE | 0.00 | 0.00 |
| AMMONIA | 0.00044 | 0.24 |
| HYDROGEN CYANIDE | 0.00018 | 0.10 |
| CARBONYL SULFIDE | 0.00013 | 0.07 |
| HYDROGEN SULFIDE | 0.00 | 0.00 |
| METHANE | 0.00 | 0.00 |
| ETHYLENE | 0.00 | 0.00 |
| ETHANE | 0.00 | 0.00 |
| PROPANE | 0.00 | 0.00 |
| n-BUTANE | 0.00 | 0.00 |
| SULFUR DIOXIDE | 0.00116 | 0.64 |

| Mass | [Fraction] | [kg/h] |
|---|---|---|
| WATER | 0.76821 | 8756.41 |
| CARBON DIOXIDE | 0.21416 | 2441.14 |
| CARBON MONOXIDE | 0.00668 | 76.16 |
| OXYGEN | 0.00344 | 39.23 |
| HYDROGEN | 0.0001 | 1.16 |
| ARGON | 0.00208 | 23.69 |
| NITROGEN | 0.00078 | 8.86 |
| ExampleFeedCoal* | 0.00 | 0.00 |
| gALUMINUM OXIDE | 0.00 | 0.00 |
| gCALCIUM OXIDE | 0.00 | 0.00 |
| gDIIRON TRIOXIDE | 0.00 | 0.00 |
| gMAGNESIUM OXIDE | 0.00 | 0.00 |
| gMANGANESE OXIDE | 0.00 | 0.00 |

-continued

| | | |
|---|---|---|
| gDISODIUM OXIDE | 0.00 | 0.00 |
| GSILICON DIOXIDE | 0.00 | 0.00 |
| AMMONIA | 0.00036 | 4.14 |
| HYDROGEN CYANIDE | 0.00023 | 2.63 |
| CARBONYL SULFIDE | 0.00037 | 4.26 |
| HYDROGEN SULFIDE | 0.00 | 0.00 |
| METHANE | 0.00 | 0.00 |
| ETHYLENE | 0.00 | 0.00 |
| ETHANE | 0.00 | 0.00 |
| PROPANE | 0.00 | 0.00 |
| n-BUTANE | 0.00 | 0.00 |
| SULFUR DIOXIDE | 0.00358 | 40.86 |
| StdLiqVolume | [Fraction] | [m3/hr] |
| WATER | 0.71573 | 8.765 |
| CARBON DIOXIDE | 0.24427 | 2.992 |
| CARBON MONOXIDE | 0.02041 | 0.250 |
| OXYGEN | 0.00722 | 0.088 |
| HYDROGEN | 0.00293 | 0.036 |
| ARGON | 0.00358 | 0.044 |
| NITROGEN | 0.00227 | 0.028 |
| ExampleFeedCoal* | 0.00 | 0.000 |
| gALUMINUM OXIDE | 0.00 | 0.000 |
| gCALCIUM OXIDE | 0.00 | 0.000 |
| gDIIRON TRIOXIDE | 0.00 | 0.000 |
| gMAGNESIUM OXIDE | 0.00 | 0.000 |
| gMANGANESE OXIDE | 0.00 | 0.000 |
| gDISODIUM OXIDE | 0.00 | 0.000 |
| gSILICON DIOXIDE | 0.00 | 0.000 |
| AMMONIA | 0.00055 | 0.007 |

The foregoing disclosure and description of the invention is illustrative and explanatory thereof. Various changes in the details of the illustrated construction can be made within the scope of the appended claims without departing from the true intent of the invention. The present invention should only be limited by the following claims and their legal equivalents.

I claim:

1. A system for generating a mixture of steam and combustion gas in a direct contact rotating steam generator using high solids content water, the system comprising:

a longitudinally rotatable drum mounted along a slope, said drum having a combustion gas supply section and a water injection section and a steam producing section and a steam and combustion gas mixture discharge section, said steam and combustion gas mixture discharge section positioned opposite said combustion gas supply section, said combustion gas supply section having an inlet, said drum having an outlet at an end thereof;

a means for injecting water at a highest point of said drum along the slope;

a means for discharging the mixture of steam and combustion gas at an end of said drum opposite said combustion gas supply section;

a plurality of chains hanging in an interior of said drum; and a means to fluidically connect said discharge steam and combustion gas so as to use energy from the mixture of steam and combustion gas.

2. The system of claim 1, further comprising:

a plurality of partitions positioned between said steam producing section and said combustion gas mixture discharge section, said plurality of partitions partially separating said steam producing section from said combustion gas mixture discharge section.

3. The system of claim 1, said combustion gas supply section being fluidically connected to an external combustion gas source.

4. The system of claim 1, further comprising:

a fixed internal combustor in said combustion gas supply section so as to internally generate the combustion gas.

5. The system of claim 1, further comprising:

a solids-removing separating means for separating solids from the discharged mixture;

a wet scrubber pressure vessel; and a discharge line extending from a bottom of said wet scrubber pressure vessel, said discharge line for recycling scrubbed solids back to said drum, the discharge steam and said wet scrubber pressure vessel being fluidically connected.

6. The system of claim 1, further comprising:

a slurry-removing separator suitable for separating a slurry from a discharge line;

a pressure drop chamber suitable for reducing a pressure of the slurry to atmospheric pressure;

a wet scrubber pressure vessel having saturated steam generated therefrom, said discharge line extending from a bottom of said pressure vessel, said discharge line suitable for recycling the scrubbed solids from the slurry back to said drum.

7. A reaction chamber apparatus for a direct contact rotating steam generator, the reaction chamber apparatus comprising:

a fixed combustion vessel;

a rotatable steam generating vessel in fluid communication with said combustion vessel, said rotatable steam generating vessel being pressurized and partially filled with a plurality of chains and having a water injection section and a steam producing section and a solids discharge section, said steam producing section positioned at a middle of said rotatable vessel, said rotatable steam generating vessel having a means for injecting water thereinto, said fixed combustion vessel having an inlet; and a connection element extending between said fixed combustion vessel and said rotatable steam generating vessel, said rotatable steam generating vessel having an outlet at an end thereof.

8. The reaction chamber apparatus of claim 7, said fixed combustion vessel having a solids discharge outlet at a bottom thereof.

9. The reaction chamber apparatus of claim 7, said fixed combustion vessel being a down-flow gasifier for generating syngas, said fixed combustion vessel having quenching water at a bottom of said gasifier, said gasifier having a quenching water discharge outlet, the discharged quenching water being recycled into the rotating steam generating vessel.

10. A method for generating steam and combustion gas mixture without liquid waste discharge, said method comprising:

mixing a carbon fuel with an oxidation gas, said carbon fuel being selected from a group consisting of hydrocarbon gas, hydrocarbon liquid, coal, heavy bitumen, vacuum residuals, asphaltin and coke, said oxidation gas selected from a group consisting of oxygen, oxygen-enriched air, and air;

combusting the mixture under pressure and elevated temperatures in a combustion section, said combustion section being in fluid connection with a rotating pressurized drum with plurality of chains therein, said chains transferring heat between different phases and having a regenerated surface by grinding solid deposits and facilitating mixture and heat transfer;

recovering a portion of the combustion heat energy in anon-direct heat exchanger for generating superheated steam for injection into an oil formation for oil recovery; and mixing water containing solids to generate steam and solid waste in a rotating drum.

11. The method of claim 10, further comprising:

transferring a liquid phase to a gas phase, said gas phase containing the steam and combustion gas; and separating solids from said gas phase.

12. The method of claim 10, further comprising:

transferring a liquid phase to a slurry phase, said gas phase containing the steam and combustion gas; and separating a slurry from said gas phase.

13. The method of claim 10, further comprising:

cleaning the gas and the steam from solid particles in a separator;

mixing the gas and the steam in a flow with heated and pressurized saturated water to produce a saturated wet steam and a gas mixture;

scrubbing any remaining solids from the gas;

separating a liquid phase from a gas phase; and recycling water with the scrubbed solids back to the rotating drum.

14. The method of claim 13, further comprising:

removing corrosive contaminating gas from the gas phase; and injecting additives to the gas phase.

15. The method of claim 13, further comprising:

reducing a pressure of the clean wet steam and the combustion gas mixture to an injection pressure so as to produce dry stream in order to prevent condensation.

16. The method of claim 13, further comprising:

adding heat to the steam and the combustion gas through a heat exchanger so as to produce a superheated dry steam and gas mixture.

17. The method of claim 16, further comprising:

injecting the superheated dry steam and gas mixture into an underground reservoir through an injection well.

18. A method for generating steam without liquid waste discharge, the method comprising:

mixing fuel with an oxidation gas in a steam generating boiler for generating steam;

mixing fuel with an oxidation gas and combusting the mixture under pressure and elevated temperatures in a rotating drum with a combustion section, said combustion section being in fluid connection with a rotating pressurized drum with plurality of chains therein, said plurality of chains transferring heat between different phases and having a regenerated surface by grinding solids and facilitating mixture and heat transfer;

mixing water containing solids to generate steam and solid waste in a rotating drum;

separating the solids;

mixing said combustion gas and said steam in a saturate pressurized water to produce a saturated wet steam and gas mixture;

recycling water with scrubbed solids back to the rotating drum;

recovering condensation heat and the steam from the saturated steam to generate high-pressure heated water flow;

using the heated water as a boiler feed water to generate high pressure steam in a boiler; and injecting the steam into an underground reservoir through an injection well.

* * * * *